US006672457B2

(12) United States Patent
Aylesworth et al.

(10) Patent No.: US 6,672,457 B2
(45) Date of Patent: Jan. 6, 2004

(54) CARD GRIPPER CAP

(75) Inventors: Gregory E. Aylesworth, Royal Oak, MI (US); Richard E. Nelson, Clawson, MI (US)

(73) Assignee: Buffalo Brothers Studios East, Inc., Royal Oak, MI (US)

( * ) Notice: Subject to any disclaimer, the term of this patent is extended or adjusted under 35 U.S.C. 154(b) by 22 days.

(21) Appl. No.: 10/004,649

(22) Filed: Dec. 3, 2001

(65) Prior Publication Data

US 2003/0102241 A1 Jun. 5, 2003

(51) Int. Cl.[7] ..... B65D 85/14; B65D 73/00

(52) U.S. Cl. ..... 206/461; 206/277; 206/806

(58) Field of Search ..... 206/461, 277, 206/467, 477, 478, 480, 483, 486, 488, 495, 806, 373, 368; 220/212.5, 751, 212; 248/227.1, 467, 468, 473; 40/124.01, 124.06, 124.4, 489

(56) References Cited

U.S. PATENT DOCUMENTS 3,162,339 A 12/1964 Lecluyse
3,180,528 A * 4/1965 Balint et al. ..... 206/806
3,370,733 A 2/1968 Giesler
4,750,642 A * 6/1988 Eckstein et al. ..... 222/81
5,348,152 A * 9/1994 Kiyoshi et al. ..... 206/480
5,373,953 A 12/1994 Fenton et al.
5,509,532 A 4/1996 Brody
5,740,911 A 4/1998 Chou
5,862,913 A * 1/1999 Chou ..... 206/806
6,032,797 A 3/2000 Kao

* cited by examiner

*Primary Examiner*—Jim Foster
*Assistant Examiner*—J. Gregory Pickett
(74) *Attorney, Agent, or Firm*—Young & Basile, P.C.

(57) ABSTRACT

A card gripper cap for a container is provided having one end releasably connectable to a container and an opposing end having a slot formed by adjacent flanges for receiving a display card. The flanges are interposed by fingers having hooks at their exposed ends for gripping or extending through the display card. The cap further has a piercer for perforating a product seal over an opening in the container and a nozzle releasably connected thereto.

21 Claims, 4 Drawing Sheets

CARD GRIPPER CAP

BACKGROUND OF THE INVENTION

The invention relates to a closure for a tube or other containers having mounting features for attaching a display card thereon.

Globalization of the economic market has made it necessary to design product packaging to meet the requirements of each country in which the product is to be sold. In particular, certain compliance requirements are required to be printed in the five languages used by current NAFTA participants. Products sold in tubes provide very little surface area for fulfilling the requirements of fully listing all regulatory information, first aid safety, and other precautionary information.

Current tube packaging systems use either a carton or a clear plastic clam shell to contain the tube and the necessary informative papers or display card, both of which involve expensive tooling and assembly procedures. These traditional methods adversely impact production lead times and lack sufficient copy area on the package to fulfill the information display needs of new and existing products. Further, when the consumer removes the product from the carton or plastic shell the packaging with its information is traditionally thrown away or lost.

SUMMARY OF THE INVENTION

The intent of the invention is to address the aforementioned concerns by providing a cap for a tube having features on the cap for gripping a display card.

In one aspect of the invention, the card gripper cap is selectively removable from the tube and has a first connection means for selectively connecting the cap to the tube and a second connection means for selectively connecting the cap to a display card.

In another aspect of the invention, the connection means from the cap to the display card includes fingers extending outwardly from the cap for gripping the card and a channel formed in the cap for receiving a portion of the card.

In another aspect of the invention, the card gripper cap includes a piercer or piercing device for penetrating a product seal over the opening of the tube.

Further, in yet another aspect of the invention, the card gripper cap includes a releasable nozzle extending from the cap for releasable connection to the tube.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
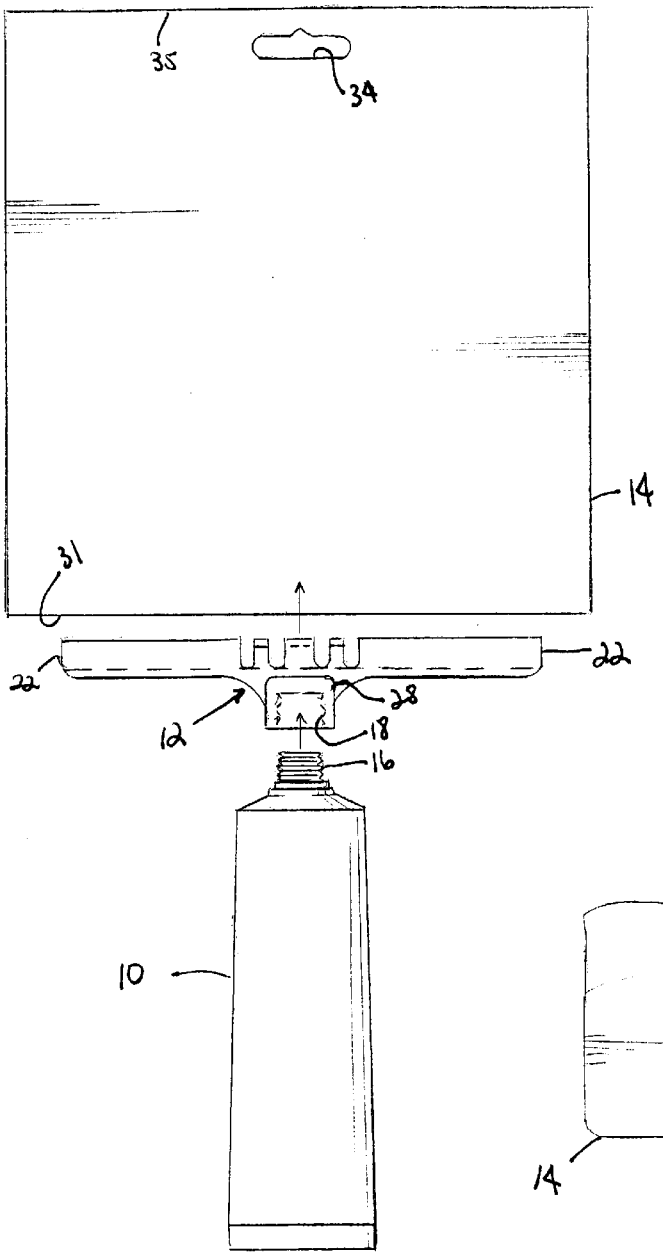
FIG. 1 is an exploded view of the tube packaging system including a tube, a card gripper cap, and a display card according to the present invention.

The invention provides a tube packaging system including a tube 10 for containing a product material therein, a cap 12 having a first connection means for selectively connecting the cap 12 to the tube 10, and a display card 14 having indicia thereon and connectable to the cap 12. The first connection means between the tube 110 and cap 12 can be conventional such as shown in the Figures wherein the neck 16 of the tube 10 is threaded and cap 12 has a corresponding internal cavity 18 which is also threaded for receiving the neck 16 of the tube 10. Other conventional connection means between the tube 10 and the cap 12 are possible.

Figure 8:
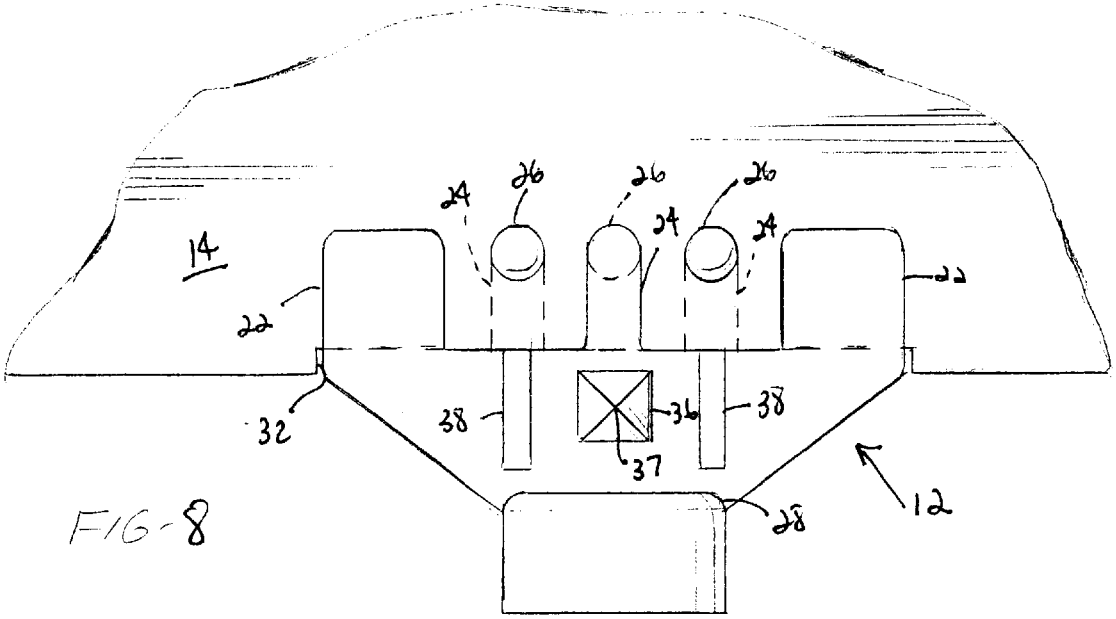
FIG. 8 shows the card gripper cap of the second embodiment connected to a display card and further having a piercer.

The cap also includes second connection means having card gripper features. The card gripper features include a slot or groove 20 formed by a pair of adjacent planar flanges 22 oriented in a direction opposite to that of the internal cavity 18. The width of the slot 20 is configured for receiving an edge of the card 14 with sufficient force to hold the card. The adjacent flanges 22 are bisected at their mid-point by a plurality of tabs or fingers 24 connected to base 28. The tabs or fingers 24 are staggered on opposing sides of the groove 20 so that the display card 14 can be gripped by the plurality of fingers 24 (as shown in FIG. 8) when inserted in the groove 20. The tabs or fingers 24 each have hooks 26 at their free ends that are facing the groove 20. The hooks 26 on adjacent tabs or fingers 24 are orientated in opposite directions so that the hooks 26 are pushing in opposition onto the display card 14 located in the groove 20. The hooks 26 can be deflected away from their normal free positions during insertion of the display card 14. The lateral space between opposing hooks 26 is less than the thickness of the display card 14 so that the subsequent applied pressure of the hooks 26 on the display card 14 retains the display card 14 in the groove 20. The force of the fingers 24 and hooks 26 on the display card 14 prevents any anticipated force, including the weight of the card gripper cap and tube with its contents from dislodging the card 14 from its secured position in the groove 20.

Figure 2:
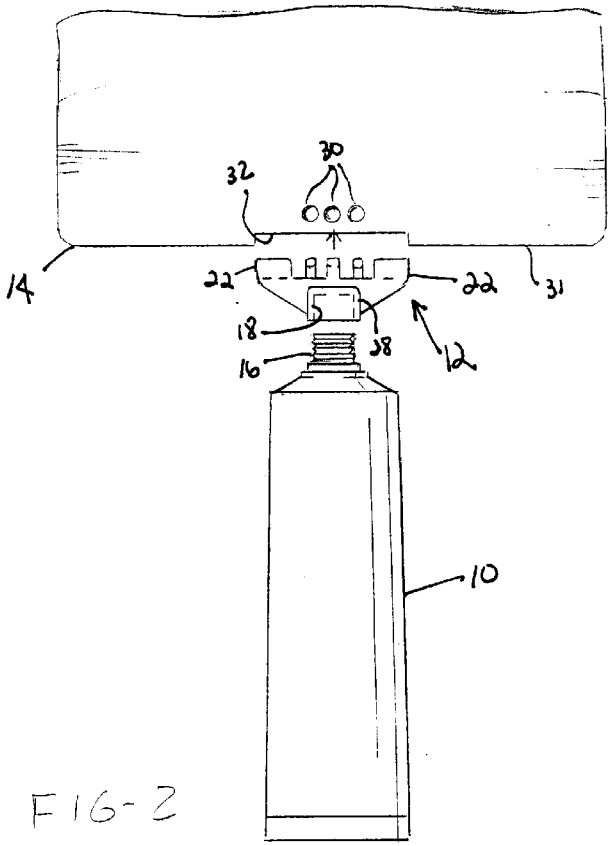
FIG. 2 is a second embodiment of the tube packaging system showing the tube, card gripper cap, and display card according to the present invention.
Figure 3:
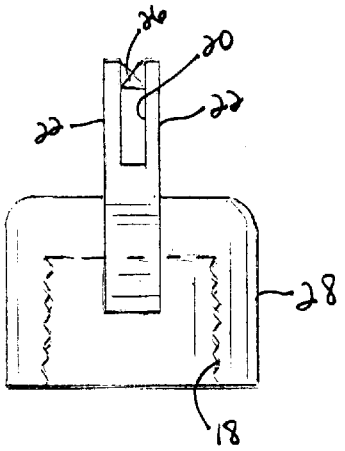
FIG. 3 is a side elevational view of the card gripper cap of the first embodiment as shown in FIG. 1.
Figure 5:
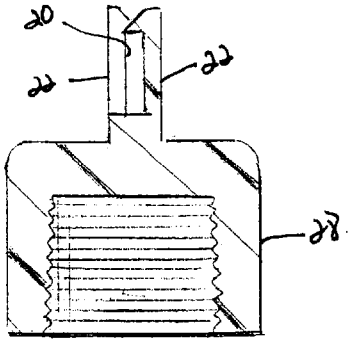
FIG. 5 is a sectional view of the card gripper cap of FIG. 4 taken along lines 5—5.
Figure 4:
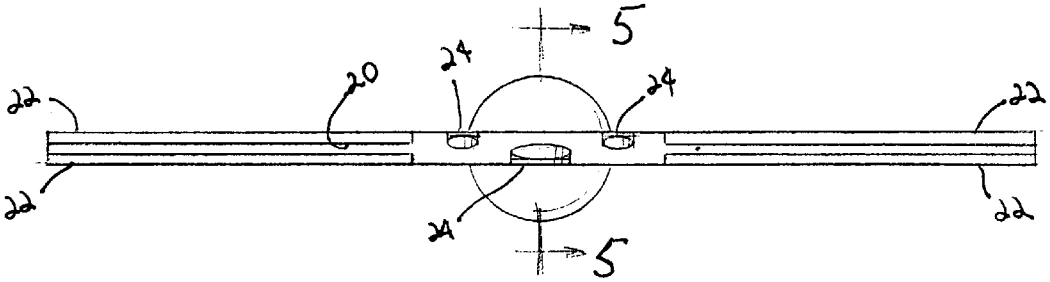
FIG. 4 is a top view of the card gripper cap according to the first embodiment as shown in FIG. 1.
Figure 6:
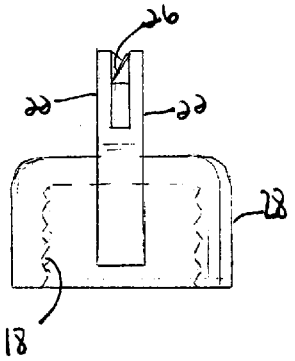
FIG. 6 is a side elevational view of the card gripper cap according to the second embodiment of the present invention as shown in FIG. 2.
Figure 7:
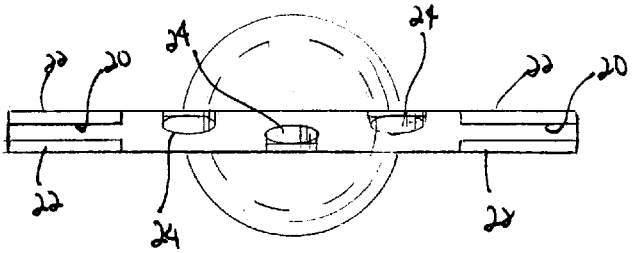
FIG. 7 is a top view of the card gripper cap according to the second embodiment as shown in FIG. 6.

As can be seen in comparing FIG. 1 and FIG. 2, the adjacent flanges 22 that form the slot or groove 20 therebetween can extend laterally from each side of the base 28 of the cap 12 which surrounds the internal cavity 18. If the flanges 22 that form the groove 20 extend to encompass most of the edge 31 of the display card 14 (as shown in FIG. 1), the force of the fingers 24 as well as the contact of the display card 14 within the groove 20 can secure the display card 24 from being dislodged from its position within groove 20.

As an alternative, if the adjacent flanges 22 extend laterally only a short distance from the base 28, as shown in FIG. 2, so that less than half of the edge 31 of the display card 14 can be secured within the groove 20, it is preferred to provide a display card 14 having through apertures 30 along its secured edge 31 for receiving the hooks 26 of the cap 12. To accommodate the display card 14 within the groove 20 when the display card 14 has through apertures 30 for receiving the hooks 26, it may be necessary to form a notch 32 in the display card 14 for proper alignment. The notch 32 is located in the secured edge 31 of the display card 14 and has a length to correspond to the length of the card in contact in the groove 20. The display card 14 may also include another aperture 34 (shown in FIG. 1) adjacent to the opposing edge 35 of the display card 14. This aperture 34 can be used for hanging the tube packaging system on a display rack (not shown).

Figure 9:
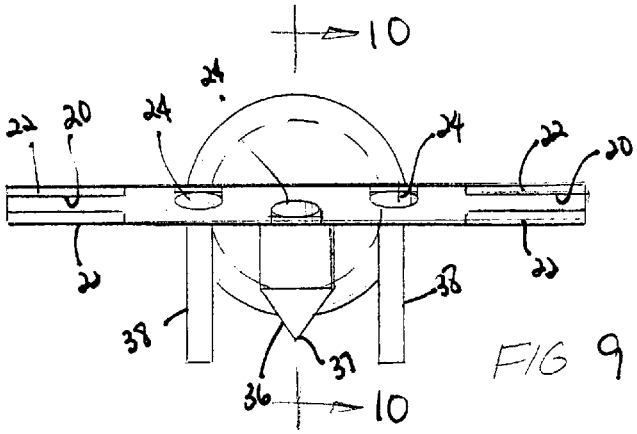
FIG. 9 is a top view of the card gripper cap having the piercer shown in FIG. 8.
Figure 10:
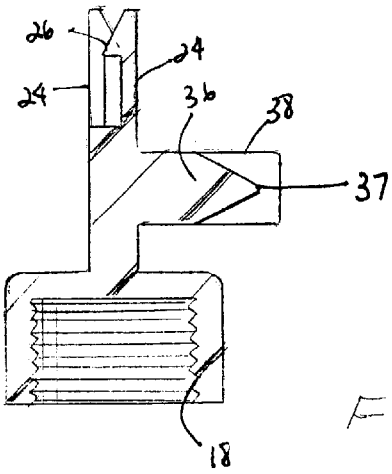
FIG. 10 is a sectional view of the card gripper cap of FIG. 9 taken along lines 10—10.

As shown in FIGS. 8–10 the cap 12 may further include a piercer or piercing device 36 extending from the base 28 of the cap 12. The piercing device 36 is provided for perforating a product seal (not shown) that is commonly used to isolate the contents within the tube 10. The piercing device 36 can be surrounded by a safety area including a circular wall or between two planar walls 38 (shown in FIG. 9) to protect a user from the pointed end 37 of the piercing device 36. The wall 38 is spaced from the piercing device 36 at a distance so that the wall 38 can extend around the exterior edge of the neck 16 of tube 10 while the piercing device 36 punctures the sealing film.

Figure 11:
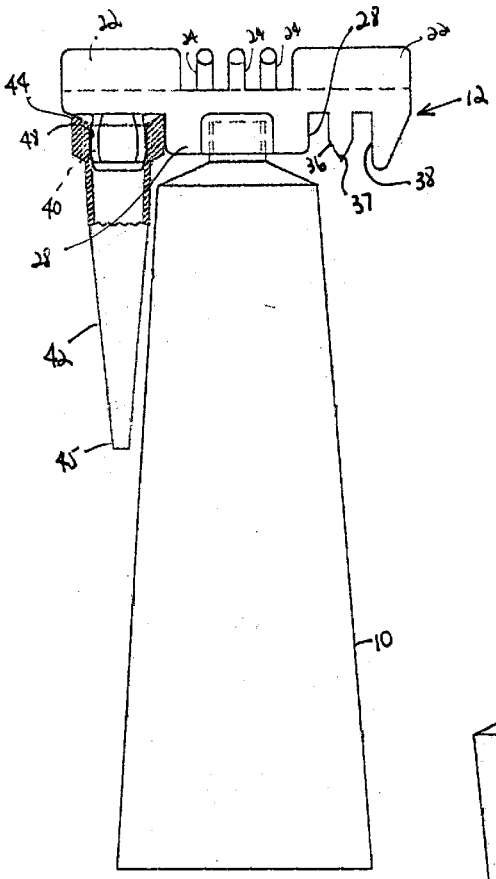
FIG. 11 is an elevational view of a third embodiment of the present card gripper cap having a nozzle engaged on the card gripper cap.
Figure 13:
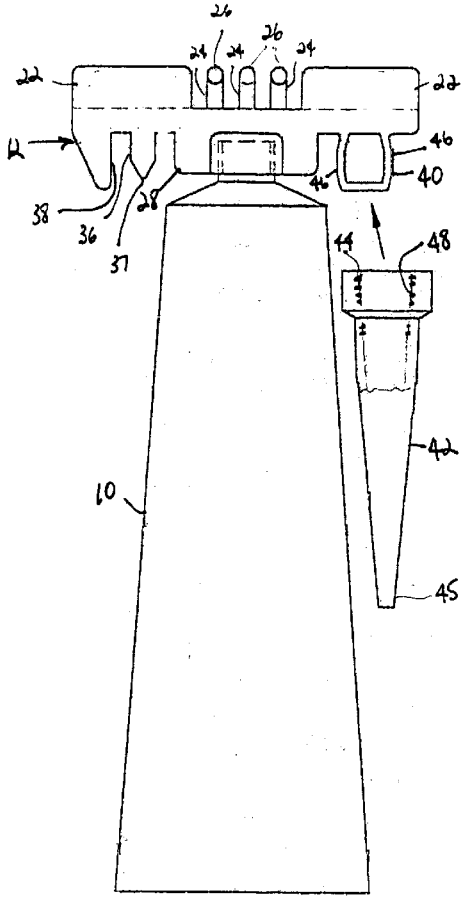
FIG. 13 is an elevational view of the card gripper cap in FIG. 11 with the nozzle disengaged from the card gripper cap.
Figure 12:
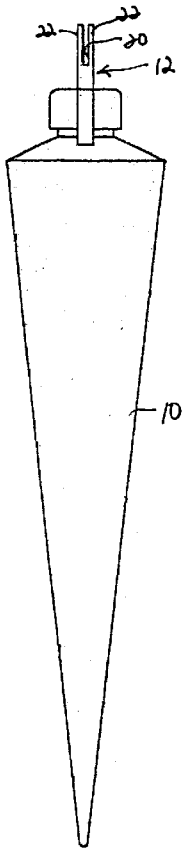
FIG. 12 is a side elevational view of the invention of the third embodiment shown in FIG. 11.

The cap 12 may also include a nozzle holding feature as shown in FIGS. 11 and 13. Many times the product material located within the tube 10 must be applied or used in a regulated stream. To narrow the flow of the product material from the tube 10 a nozzle 42 is provided having an internally threaded first end 44 which can be secured to the neck 16 of the tube 10, and a tapered second end 45. The cap 12 may include a nozzle holder 40 to which the nozzle 42 can be releasably attached. The nozzle 42 is held in an attached configuration by outwardly curved sides 46 of nozzle holder 40 which push outwardly against the threaded inner surface 48 of the nozzle 42. The nozzle 42 can then be selectively released from the cap 12 for use; and later reconnected or snapped onto the nozzle holder 40 for storage.

FIG. 11 and FIG. 13 also show another embodiment of the piercing device 36. In this embodiment, the piercing device 36 extends from one of the flanges 22 in the opposite direction from the fingers 24. To protect the user from the pointed end 37 of the piercing device 36, the piercing device 36 is positioned between a wall 38 on one side and the exterior surface of the base 28 on the other side.

The tube packaging system is assembled by conventionally inserting the neck 16 of the tube 10 into the internal cavity 18 of the cap 12. The cap 12 is securely attached to neck 16 by threading the cap 12 onto the neck 16. The display card 14 is then inserted into the groove 20 of the cap 12 so that the hooks 26 of the fingers 24 are pressing against the card 14. If the display card 14 includes corresponding apertures 30, then the hook 26 can be disposed within the apertures 30 for added securement. The tube packaging system can be displayed by hanging on a rack by using aperture 34 or placing on a shelf. The tube packaging system can be transported to the retail store with the display card 14 either connected or separate from the tube 10 and cap 12. The display card 14 can be easily assembled to the tube 10 and cap 12 at the retail store to save shipping and handling costs.

The tube packaging system as described supra provides many benefits over the prior art. The current invention eliminates the material and assembly cost for the carton or clam shell packaging configuration. The snap-together modular components of the tube packaging system of the present invention help reduce inventory requirements by consolidating several part numbers. The tube packaging system of the present invention further minimizes handling, reduces shipping costs, and simplifies tracking logistics. Including the double-sided display card with the tube packaging system increases usable space for providing content information, instructions, and safety precautions in multiple languages to adhere to regulatory compliance. The display card also allows larger print for improved visibility and reading of the instructions and safety precautions. Any changes to the content information, instructions, or safety precautions for the product can be easily made by substituting display cards having the correct information without wasting existing tubes containing the product material. Therefore, lead times for new or revised packaging are considerably shorter and less expensive.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law. For example, the plurality of fingers 24 that grip the display card 14 may have identical or dissimilar sizes. As another example, the card gripper cap 12 can include perforations, indentations, or thinning of the material (not shown) around the base 28 so that the flanges 22 and associated groove 20 and fingers 24 can be snapped off and removed from the base 28 and its associated internal cavity 18 by the user.

What is claimed is:

1. A card gripper cap selectively removable from a container, said cap comprising:

first connection means for selectively connecting said cap to the container; and second connection means for selectively connecting said cap to a card, wherein said second connection means includes at least one finger having first and second sides and a groove extending from each side of the at least one finger, the groove defined by a pair of adjacent planar flanges for receiving a portion of the card between said flanges.

2. The card gripper cap of claim 1, wherein said container has a threaded male end and said first connection means has a threaded orifice for receiving the threaded male end of the container, wherein the threaded orifice and the at least one finger are disposed along a longitudinal axis of the cap and the groove extends substantially transverse with respect to the longitudinal axis.

3. The card gripper cap of claim 2, wherein said at least one finger further comprises:

a plurality of fingers for selectively connecting said cap to the card, wherein said fingers define corresponding hooks and a lateral space defined between adjacent hooks is less than a thickness of the card.

4. The card gripper cap of claim 1, wherein said at least one finger has an end hook extendable through an aperture defined by said card.

5. The card gripper cap of claim 1 further comprising:

a piercer spaced a predetermined distance from the first connection means and positioned orthagonally with respect to a longitudinal axis of the groove.

6. The card gripper cap of claim 1 wherein the groove is defined by opposing planar flanges.

7. The card gripper cap of claim 1 wherein second connecting means is sized to correspond to a notch defined by the card.

8. The card gripper cap of claim 1 further comprising a piercer extending in a direction transverse relative to a longitudinal axis of the cap.

9. The card gripper cap of claim 1 further comprising:

a nozzle holder.

10. A tube packaging system comprising:

a tube for containing viscous material having one end sealingly closed and a neck portion at the second end;

a cap having an internal cavity for receiving the neck portion of the tube;

said cap further having a connection means for selectively connecting said cap to a card, wherein said connection means includes at least one finger having first and second sides and a groove extending from each side of the at least one finger, the groove defined by a pair of adjacent planar flanges for receiving a portion of the card between said flanges.

11. The tube packaging system of claim 10, wherein the neck of the tube is thread ably connectable to the cap.

12. The tube packaging system of claim 10, wherein the at least one finger further comprises:

at least two spaced fingers for receiving a portion of the card therebetween, wherein said fingers define corresponding hooks and a lateral space defined between adjacent hooks is less than a thickness of the card.

13. The tube packaging system of claim 12, wherein each hook is extendable through a corresponding aperture defined by said card.

14. The tube packaging system of claim 10, wherein the cap further comprises a piercing means having a longitudinal axis disposed within a safety area extending from said cap, wherein said piercing means is one of spaced from the first connection means a predetermined distance and positioned such that the longitudinal axis of the piercer is substantially parallel with respect to a planar axis of the card.

15. A tube packaging system comprising:

a tube for containing viscous material having one end sealingly closed and a neck portion at the second end;

a cap having an internal cavity for receiving the neck portion of the tube, wherein the cap has the internal cavity at one end and at least two spaced fingers at the other end for receiving a portion of a card therebetween, wherein each finger has an exposed end with a hook thereon for extending through said card; and said cap further having a connection means for selectively connecting said cap to a card, wherein the cap further comprises a pair of adjacent planar flanges forming a slot therebetween for receiving a portion of the card therein.

16. The tube packaging system of claim 15, wherein the hooks are oriented to face toward the slot.

17. A tube packaging system comprising:

a tube for containing viscous material having one end sealingly closed and an opposing end with a neck configuration;

a cap having an internal cavity for receiving the opposing end of the tube and a gripping means; and a card releasably secured to the gripping means of the cap, wherein the gripping means comprises fingers extending from one end of the cap, each finger having an exposed end with a hook thereon and said card having through apertures for receiving the hooks.

18. The tube packaging system of claim 17, wherein said cap further comprises adjacent flanges forming a slot therebetween for receiving a portion of the card, wherein the slot and fingers are oriented to hold the card therebetween.

19. The tube packaging system of claim 18, wherein the cap further comprises a safety area extended therefrom and having a piercing means disposed thereon.

20. The tube packaging system of claim 10, wherein the cap further comprises a nozzle releasably connected to said cap.

21. A card gripper cap selectively removable from a container, said cap comprising:

first connection means for selectively connecting said cap to the container;

second connection means for selectively connecting said cap to a card, wherein the second connection means includes at least one finger having first and second sides; and a groove having a first portion extending from the first side of the at least one finger, and a second portion extending from the second side of the at least one finger, wherein the groove is discontinuous.

* * * * *